United States Patent [19]

Beltzer

[11] Patent Number: 4,793,084

[45] Date of Patent: Dec. 27, 1988

[54] CYLINDER FIREARM, AND AN ASSOCIATED IMPROVED CYLINDER

[75] Inventor: Jean Beltzer, Lutterbach, France

[73] Assignee: Matra Manurhin Defense, Velizy-Villacoublay, France

[21] Appl. No.: 69,268

[22] Filed: Jul. 2, 1987

[30] Foreign Application Priority Data

Jul. 4, 1986 [FR] France ..... 86 09749

[51] Int. Cl.[4] ..... F41C 1/00; F41D 11/32

[52] U.S. Cl. ..... 42/59; 89/26

[58] Field of Search ..... 42/59, 65, 1.05; 89/26

[56] References Cited

U.S. PATENT DOCUMENTS

| | | | |
|---|---|---|---|
| 790,634 | 5/1905 | Hirch | 42/1.05 |
| 2,866,386 | 12/1958 | Lucht | 89/26 |
| 3,106,865 | 10/1963 | Hepperle | 89/26 |
| 3,159,938 | 12/1964 | Treat et al. | 89/26 |
| 3,768,362 | 10/1973 | Grimm et al. | 89/26 |
| 3,889,572 | 6/1975 | Vorgrimler et al. | 89/26 |
| 3,968,726 | 7/1976 | Grimm et al. | 89/26 |
| 4,694,602 | 9/1987 | Pust | 42/59 |

FOREIGN PATENT DOCUMENTS

| | | | |
|---|---|---|---|
| 58338 | 2/1891 | Fed. Rep. of Germany . | |
| 7787 | 3/1892 | Fed. Rep. of Germany | 42/59 |
| 15753 | 2/1910 | United Kingdom . | |

OTHER PUBLICATIONS

Article entitled: "Les Revolvers A Joint Obturá".

*Primary Examiner*—Charles T. Jordan
*Assistant Examiner*—Michael J. Carone
*Attorney, Agent, or Firm*—Woodcock Washburn Kurtz Mackiewicz & Norris

[57] ABSTRACT

The invention relates to a cylinder firearm whose cylinder (100) includes a plurality of chambers (108). The cylinder (100) includes a channel (101) associated with each of its chambers (108) and opening out into said chamber ahead of any cartridge contained therein, with the other end of each channel receiving a piston (111), which piston presses against the frame of the gun when fired, thereby causing the cylinder to move forwardly by reaction and thus suppressing the operating clearance provided between the cylinder and the barrel and thus providing good sealing at the front of each chamber when fired. The invention is particularly applicable to revolvers.

18 Claims, 2 Drawing Sheets

CYLINDER FIREARM, AND AN ASSOCIATED IMPROVED CYLINDER

The present invention relates to firearms having a cylinder, i.e. a revolving breech, and more particularly but not exclusively to cylinder revolvers.

BACKGROUND OF THE INVENTION

A cylinder, regardless of whether it can be swung out or not, comprises a plurality of chambers each capable of receiving one round or cartridge, and is mounted on a coaxial shaft in an associated housing in the frame of a gun.

It is essential to provide operating clearance between the cylinder and the barrel in order to allow the cylinder to rotate automatically about its axis after each shot, so as to present the projectile guidance and firing mechanism with a new prior-loaded cartridge. This operating clearance is necessary a fortiori in a gun having a cylinder which can be swung out to enable the gun to be loaded by pivoting the cylinder assembly about a pivot axis which is parallel to, but offset from, its axis of symmetry.

It is well-known that the accuracy of firearms depends on numerous factors.

In addition to purely structural factors such as the accuracy of the alignment between the barrel and the associated cylinder, or the state and the rectitude of the rifling in the barrel, shooting accuracy is greatly influenced by the initial speed of the projectile. For a given projectile, i.e. for a given quantity of explosive contained in the tubular casing of the cartridge, this speed depends essentially on the pressure inside the chamber during combustion of the propellant explosive, and thus on the quality of the sealing that must be provided between the combustion chamber and its surroundings.

In all guns using cartridges, rearwards sealing is provided by the tubular casing of the cartridge coming into contact with the adjacent inside wall of the chamber.

In contrast, forwards sealing is provided by the gun mechanism. This forwards sealing is particularly sensitive in cylinder guns since they require operating clearance between the cylinder and the barrel, as recalled above.

One very old technique proposed at the end of the last century by the Nagant brothers relied on the principle of sealing being provided between the tubular casing of the cartridge and the inlet to the barrel.

According to this principle, the round is made to penetrate into the revolver barrel in order to provide a continuous tube: the cylinder is moved forwardly by an actuating pusher connected to the trigger so that the front end of the cartridge casing with the projectile contained therein then penetrates into the rear end of the barrel; when pressure is released, a spring returns the cylinder rearwardly, thereby disengaging the empty cartridge casing from the barrel and enabling the cylinder to be rotated.

This technique, although highly ingenious for the period, nevertheless suffers from major drawbacks. Firstly a step must be provided inside the barrel in order to provide an abutment for the cartridge casing; and this requires special ammunition since the projectile needs to be completely enveloped by the cartridge casing since otherwise the cylinder would have to move an excessive distance axially. Further, this mechanism requires several parts for organizing cylinder displacement in an axial direction and this is disadvantageous both in terms of reliability and in terms of manufacturing costs.

Techniques similar to those of the Nagant brothers are described in British Pat. No. 15 753 (1909) and in German Pat. No. 58 338: both describe moving cylinder systems using an actuator pusher linked to the gun mechanism.

In order to avoid these drawbacks, current techniques seek to reduce the operating clearance between the cylinder and the barrel to as small a value as possible. Careful machining makes it possible to achieve small clearances, for example of the order of a few tenths of a millimeter, however the clearance is never eliminated.

In addition, the presence of this operating clearance means that it is not possible to prevent incandescent particles from escaping through the gap (such hot grains of explosive are often called "back-firing" by persons skilled in the art). It should be observed that this particular drawback is avoided with the above-mentioned Nagant brothers' technique by virtue of the continuous tube principle.

Proposals have also been made to use a sealing ring disposed in the front portion of the cylinder, which ring is projected against the adjacent end of the barrel during firing in order to locally close the gap between the barrel and the front face of the cylinder (see U.S. Pat. No. 3,768,362 for example). Nevertheless these techniques are complicated and expensive (the ring must be made of a high quality material in order to withstand the high temperatures involved).

Finally, the state of the art is also illustrated by systems adapted for cartridge-free rounds for automatic guns: the cylinder is movable along a helical path for loading the breech or for ejecting an unfired round, but said cylinder remains in a single longitudinal firing position (see U.S. Pat. No. 3,889,572, for example).

The aim of the invention is to provide a cylinder firearm, and an associated improved cylinder, suitable for providing very good front sealing between the cylinder and the barrel of the gun, without requiring an actuator mechanism using several moving mechanical parts, and without requiring the use of special ammunition in which the cartridge casing completely covers the projectile.

SUMMARY OF THE INVENTION

More particularly, the present invention provides a cylinder firearm whose cylinder includes a plurality of chambers and is capable of rotating on a rod coaxial therewith and inside a housing associated with the frame of the firearm, the firearm being characterized by the fact that the cylinder includes a channel associated with each chamber and opening out into said chamber ahead of the casing of a cartridge placed therein, the other end of said channel receiving a sliding closure member, and by the fact that said sliding closure member presses against the frame of the firearm during firing under the effect of the pressure of the combustion gases and, by reaction thereto, causes the cylinder to move forwardly until the operating clearance between the cylinder and the barrel is eliminated.

A communicating path could be provided between two or more channels, but higher efficiency is obtained if each channel is completely independent from the other channels provided in the cylinder.

The channel associated with each chamber may be rectilinear and inclined, in which case it opens out in the side surface of the cylinder, thereby requiring the gun frame to be suitably adapted. The channel may alternatively be curved, but in that case it is particularly difficult to machine. It is therefore preferable for each channel to be of substantially circular cross-section, and to be constituted by a rectilinear front portion opening out into the associated chamber, and a rectilinear rear portion which is connected thereto and which opens out into the rear face of the cylinder.

In this case, the axis of the rectilinear rear portion of each channel in the cylinder is preferably parallel to the axis of the associated chamber.

Advantageously, the axis of the rectilinear front portion of each channel intersects the axis of the associated chamber, and in particular is perpendicular to the axis of the associated chamber. In order to make good use of the material from which the cylinder is made, the plane defined by the axes of the rectilinear portions of each channel is substantially perpendicular to the plane defined by the axis of the associated chamber and the axis of the cylinder.

In a first type, the rectilinear front portion does not open out into the outside of the cylinder. An electro-erosion type of machining technique is therefore preferably used. According to another type, the rectilinear front portion opens outwardly beyond its connection to the rectilinear rear portion, and includes an added closure member. In this case, the rectilinear front portion of each channel is at least partially tapped, with the closure means being constituted by a threaded plug, or else the added closure means is crimped and is of the plug type or of the ball type.

The sliding closure member may be common to two or more channels, in particular to avoid generating a parasitic couple, but it is simpler to provide for the sliding closure member to be an elongate piston, with each piston being independent from the other pistons provided in the cylinder, since the abovementioned couple effect is negligible in practice.

In order to increase the efficiency of the system, it is advantageous for each piston to slide in an end bore in the channel having a diameter which is substantially greater than the average diameter of said channel.

In order to avoid any risk of losing a piston, each piston is associated with a stop member in order to limit its outwards stroke from the cylinder. Preferably, this stop member is fixed in an associated channel opening out sideways to the outside of the cylinder, with the end of said stop member cooperating with an abutment provided on the piston, and in particular, the end of the stop member may penetrate into a grove in the piston with the front edge thereof constituting the abutment.

The invention also provides an improved cylinder for fitting to a cylinder firearm (regardless of whether the cylinder can be swung out or not), said cylinder including, in conventional manner, a plurality of chambers. A cylinder according to the invention is characterized by the fact that it further includes a channel associated with each chamber and opening out into said chamber ahead of a cartridge, and by the fact that the other end of said channel opens out in the rear face of the cylinder and receives a closure member capable of sliding freely like a piston.

Preferably, as mentioned above, a stop member fixed in an associated channel opening out sideways is associated with each piston in order to limit its rearwards stroke.

BRIEF DESCRIPTION OF THE DRAWINGS

Embodiments of the invention are described by way of example with reference to the accompanying drawings, in which.

MORE DETAILED DESCRIPTION

Figure 1:
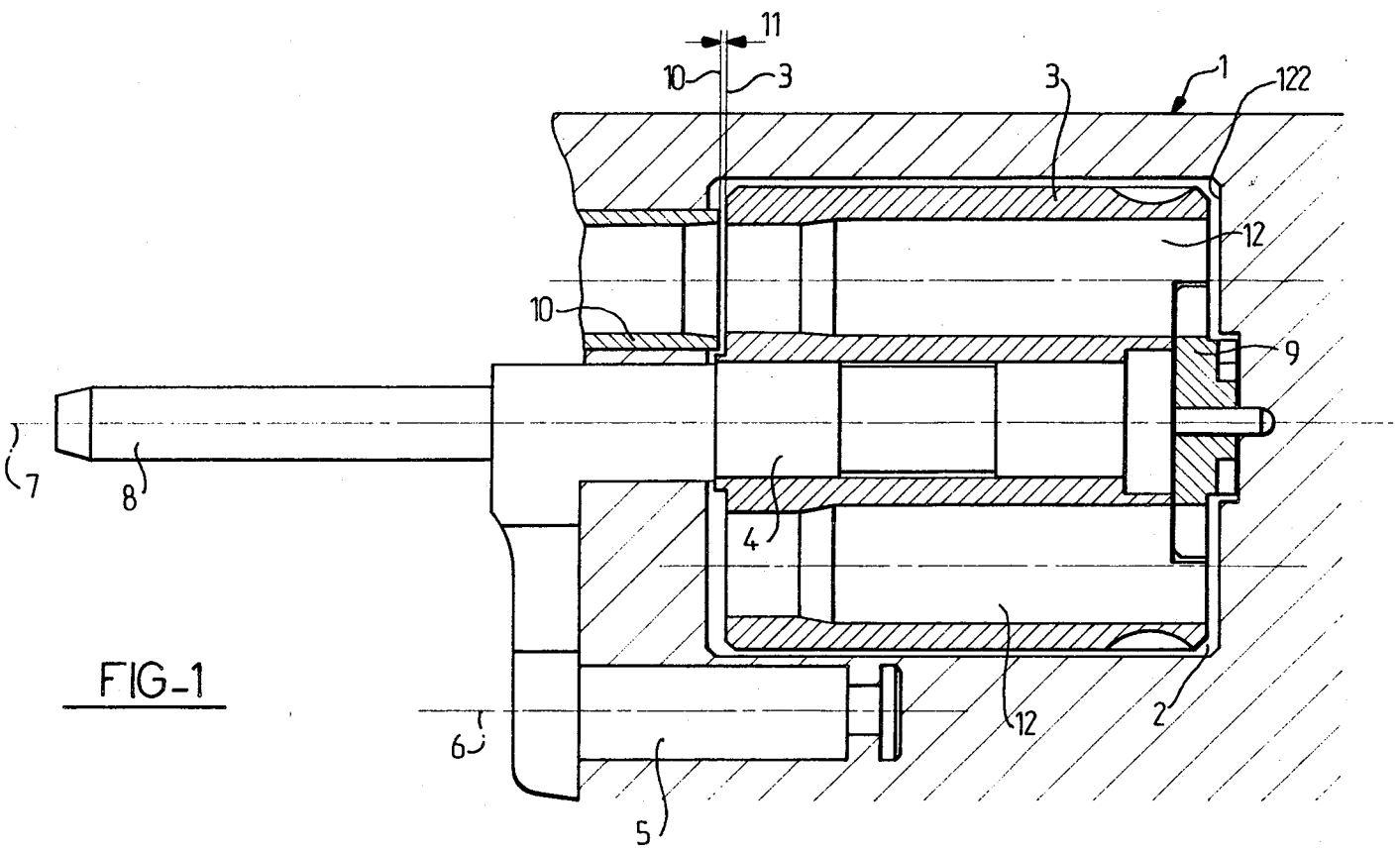
FIG. 1 is an axial section showing a fragment of a conventionally designed cylinder firearm, with the cylinder being a swinging cylinder.

FIG. 1 is an axial section showing a portion of a conventionally designed cylinder firearm, with the cylinder being a swinging cylinder. It shows a cylinder revolver of a commonly encountered type comprising a frame 1 having a housing 2 which receives a cylinder 3 capable of rotating about a coaxial rod 4. The rod 4 is connected to to a cylinder pivot 5 enabling the cylinder to be swung out for loading the revolver by swinging the cylinder assembly about an axis 6 which is parallel to the axis of symmetry 7 of the cylinder, but which is offset therefrom. An ejector rod 8 can also be seen whose rear end is connected to a central ejector 9 for simultaneously ejecting all of the cartridges from the cylinder when the cylinder is swung out. The inlet to the barrel 10 can also be seen together with the operating clearance 11 between the front face of the cylinder and the rear edge of the inlet to the barrel (which operating clearance is generally about a few tenths of a millimeter). In conventional manner, the cylinder 3 includes a plurality of chambers 12 for receiving cartridges. Each chamber 12 may comprise a conical bore and a cylindrical bore, with these two bores being interconnected by a section that may be straight, or may be conical as shown here (as applicable to a 357 Magnum, for example).

Thus, as explained above, the initial speed of the projectile depends essentially on the pressure existing in the chamber during combustion of the propellant explosive, and thus on the quality of the sealing provided between the combustion chamber and its surroundings. Rearwards sealing is always provided by the cartridge casing itself coming into contact with the adjacent inside wall of the chamber, whereas forwards sealing as provided by the gun mechanism results from the machining of the faces which define the operating clearance 11, which machining must be performed as carefully as possible in order to minimize the operating clearance.

In this conventional design, the presence of the operating clearance 11 means that front sealing is necessarily imperfect and does not make it possible to avoid back-firing together with irregularities in speed and/or accuracy.

Figure 2:
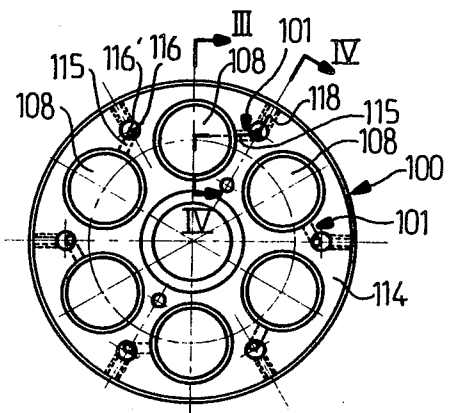
FIG. 2 is a rear view of a cylinder in accordance with the invention, from which the closure pistons have been removed in order to clarify the drawing.

The invention seeks in particular to eliminate this operating clearance between the cylinder and the barrel, and this is described with reference to FIGS. 2 to 4.

In accordance with the an essential aspect of the invention, the cylinder 100 includes a channel 101 associated with each chamber 108 and opening out into said chamber at an orifice 109 situated ahead of the casing 110 of the ammunition located therein, with the other end of said channel receiving a sliding closure member 111. Ween the gun is fired, the sliding closure member 111 presses against the gun frame under the effect of the pressure generated by the combustion gases, and by reaction it causes the cylinder 100 to move forwardly until the operating clearance 11 between the cylinder and the barrel is eliminated. Thus, on firing, very high quality forwards sealing is provided, thereby making it possible to obtain a substantially higher initial speed for the projectile 112 than is possible with conventional systems.

It should be observed that this sealing is provided much more simply than in the Nagant brothers' system, since there is no mechanical transmission for thrusting the cylinder forwardly, said cylinder being almost instantaneously pressed against the inlet to the barrel under the effect of the pressure due to the combustion gases (for example, it is estimated that the forwards motion of the cylinder is completed in about 1/10,000-th of a second). Thus, the ideal principle of a continuous tube at the moment of firing is obtained by other means while using conventionally designed ammunition which does not require the projectile to be enveloped by the cartridge casing.

Figure 3:
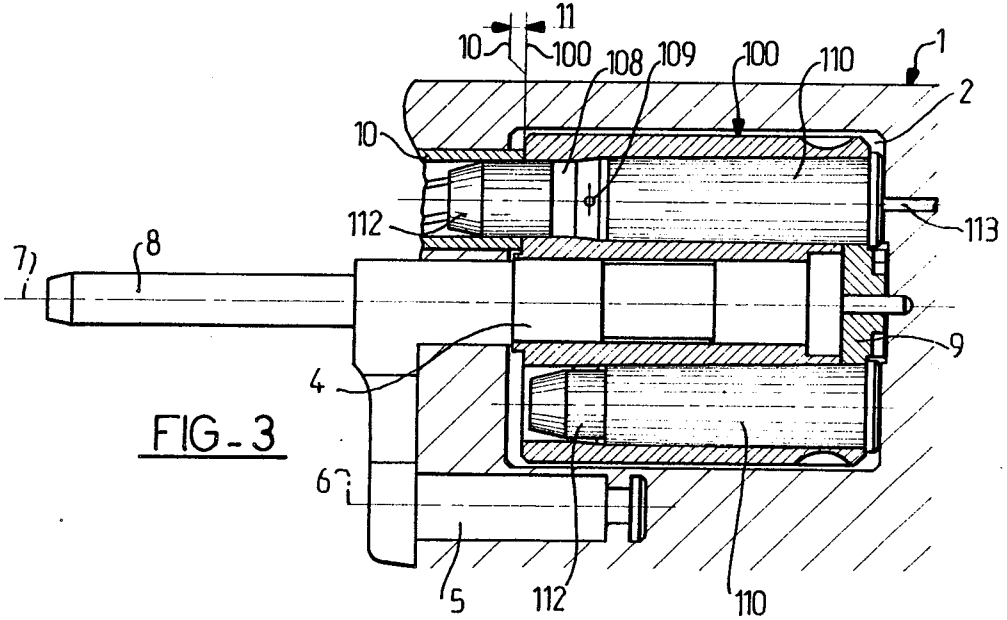
FIG. 3 is a section on line III—III of FIG. 2 included in a fragmentary section of the gun in which the cylinder is received, and showing a projectile at the beginning of its movement.

FIG. 3 shows a situation at the moment when the hammer 113 has just been actuated with the projectile 112 just beginning to enter into the barrel inlet. This figure shows only the orifice 109 through which the channel 101 opens out into the combustion chamber.

A communicating path could be provided between two or more of the channels 101, but the system is more effective if each channel is totally independent from the other channels provided in the cylinder 100. FIG. 2 shows one such embodiment having six chambers 108, and six associated channels 101, each opening out at one end into a corresponding chamber 1O8 and at the other end into the rear face 114 of the cylinder.

Figure 4:
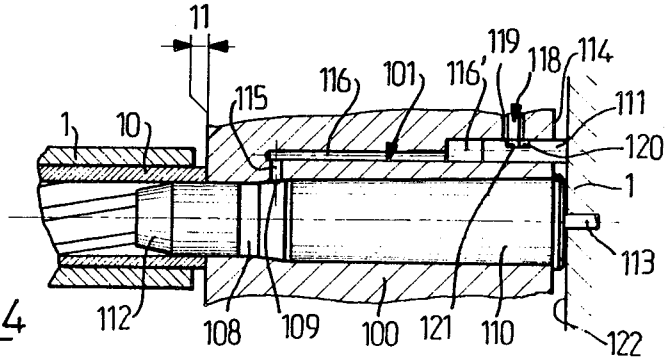
FIG. 4 is a fragmentary section on line IV—IV of FIG. 2 included in a detail section of the gun for better distinguishing the communication channel and its closure piston.

FIG. 4 illustrates one possible configuration for the channels 101. Each channel 101 is thus constituted by a rectilinear front portion 115 opening out into the associated chamber 108, and a rectilinear rear portion 118 opening out into the rear face 114 of the cylinder. A single sloping rectilinear channel could have been provided opening out into the side face of the cylinder, but this would have required the frame of the to be correspondingly adapted, which would not be so rational. In this case, the rectilinear rear portion 116 is parallel to the axis of the associated chamber 108, but it is obvious that each of the rear portions could be at a small angle.

The rectilinear front portion 115 has an axis which intersects the axis of the associated chamber 108 and is substantially perpendicular thereto. In order to avoid weakening the mechanical strength of the cylinder 100, the channel 101 must be properly placed between two adjacent chambers 108: thus, good utilization is made of the cylinder material by ensuring that the plane defined by the axes of the rectilinear portions of each channel 101 in substantially perpendicular to the plane defined by the axis of the associated chamber and the axis of the cylinder (in FIG. 2, this means that the portion 115 and the plane of symmetry of the cylinder passing through the axis of the associated chamber 108 are orthogonal).

Figure 5:
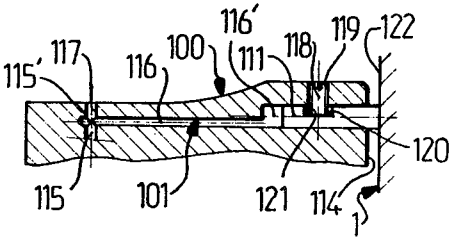
FIG. 5 is a fragmentary section showing a variant of FIG. 4 in which the channel includes an outwardly opening portion which is closed.

Various different designs may be considered for the configuration of the channel 101, but the person skilled in the art must take care to satisfy both the requirements of ease of machining and the fact that the total length of each channel should be as short as possible, as should the distance between the orifice 109 and the front edge of the cartridge casing, so as to minimize the ultra-rapid reaction time for moving the cylinder forwards when firing. It would thus be possible to design a curved channel providing high performance as to reaction time, however it would be particularly difficult to machine. A channel comprising two rectilinear portions that meet each other is thus clearly preferable. The rectilinear rear portion 116 can be be drilled without any special problem, but the rectilinear front portion 115 may be more difficult: one possibility is to make this a sloping portion so as to enable a machining tool to be advanced into the chamber, but other techniques need to be used if this portion is to be substantially perpendicular to the axis of said chamber. If it is desired that the rectilinear front portion should not open out to the outside of the cylinder, a machining technique of electro-erosion type should preferably be used; however, if this portion may open out to the outside, then machining is considerably simplified but added closure means must then be provided. This variant is illustrated in FIG. 5 which is a fragmentary section serving to distinguish a rectilinear portion 115 of the channel which extends beyond its connection in the form of a portion 115' which opens out sideways, and which has an added closure means 117 disposed therein. If the portion 115' is tapped, then the closure means may be a threaded plug, however it is also possible to define a plug or ball type closure means which is crimped inside the portion 115'.

The sliding closure member may be common to two or more channels by providing a connection projecting from the rear face of the cylinder, in particular for the purpose of preventing a parasitic couple from appearing. However, it is preferable for each sliding closure member 111 to be an elongate piston and for each piston to be independent from the other pistons provided in the cylinder. This is the simplest solution and has very little unwanted effect on the performance of the system as a whole since the above-mentioned couple effect is negligible in practice. Thus, as shown in FIG. 4, it is advantageous to provide for the piston 111 to slide in a end bore 116' of the channel whose diameter is substantially greater than the average diameter of said channel. In practice, the portions 115, 116, and 116' are of substantially circular cross-section.

In order to avoid any risk of losing a piston 111 when manipulating the cylinder, it is advantageous to provide a stop member 118 which is fixed in an associated channel 119 which opens out sideways to the outside of the cylinder, and whose end co-operates with an abutment provided on the piston. Thus, as shown in FIGS. 4 and 5, a stop member may be provided in the form of a nipple screw whose tip penetrates into a groove 120 in the piston 111, with the front edge 121 of said groove constituting the abutment. Naturally there should be a degree of clearance between the end of the stop member 118 and the abutment 121 in order to ensure that the active portion of piston motion is not hindered in any way during firing, in which case the rear portion of said piston is thrust violently against the facing face 122 of the frame. It should be observed that the cylinder 100 as described above can be directly fitted to an existing firearm having a conventional cylinder.

Consequently, the invention also extends to a cylinder having the characteristic of a channel 101 associated with each chamber and opening out into said chamber ahead of the casing of any cartridge that may be placed therein, with the other end of said channel opening out into the rear face of the cylinder and receiving a closure member 111 which is free to slide like a piston. Preferably, a cylinder in accordance with the invention includes a stop member 118 associated with each piston 111 in order to limit its rearwards stroke.

The invention is not limited to the above-described embodiment, but on the contrary covers any variant using equivalent means to provide the essential characteristics which appear in the claims.

In particular, the invention applies to any cylinder firearm and not only to revolvers.

I claim:

1. A cylinder firearm including a frame, a barrel, and a cylinder having a plurality of cartridge-receiving chambers, said cylinder being rotatably mounted on a rod coaxial therewith inside a cylinder-receiving housing associated with said frame, and being free to rotate relative to said barrel by virtue of an operating clearance between said cylinder and said barrel, the firearm including the improvement whereby said cylinder includes a channel associated with each chamber and opening out at one end into said chamber ahead of the casing of a cartridge placed therein, with the other end of said channel receiving a sliding closure member, said sliding closure member being disposed to press against said frame when said firearm is fired under the effect of the pressure of the combustion gases and, by reaction thereto, causing said cylinder to move forwardly until said operating clearance is eliminated.

2. A firearm according to claim 1, wherein each channel is completely independent from the other channels provided in the cylinder.

3. A firearm according to claim 1, wherein each channel is of substantially circular section, and is constituted by a rectilinear front portion opening out into the associated chamber, and a rectilinear rear portion connecting therewith and opening out into the rear face of the cylinder.

4. A firearm according to claim 3, wherein the axis of the rectilinear rear portion of each channel is essentially parallel to the axis of the associated chamber.

5. A firearm according to claim 3, wherein the axis of the rectilinear front portion of each channel intersects the axis of the associated chamber.

6. A firearm according to claim 5, wherein the axis of each rectilinear front portion is substantially perpendicular to the axis of the associated chamber.

7. A firearm according to claim 5, wherein the plane defined by the axes of the rectilinear portions of each channel is substantially perpendicular to the plane defined by the axis of the associated chamber and the axis of the cylinder.

8. A firearm according to claim 5, wherein the rectilinear front portion of each channel extends only from its respective chamber to the front end of the rectilinear rear portion.

9. A firearm according to claim 5, wherein the rectilinear front portion of each channel opens out to the outer surface of the cylinder beyond its connection with the rectilinear rear portion thereof, and includes an added closure means.

10. A firearm according to claim 9, wherein the rectilinear front portion of each channel is at least partially tapped, with the associated closure means being a threaded plug.

11. A firearm according to claim 9, wherein the added closure means in each channel is of the stopper type and is held in place by crimping.

12. A firearm according to claim 1, wherein each sliding closure member is an elongate piston, with each piston being independent from the other pistons provided in the cylinder.

13. A firearm according to claim 12, wherein each piston slides in an end bore of its channel having a diameter which is substantially greater than the average diameter of said channel.

14. A firearm according to claim 12, wherein a stop member is associated with each piston in order to limit its outwards stroke from the cylinder.

15. A firearm according to claim 14, wherein the stop member is fixed in an associated channel opening out sideways to the outside of the cylinder, with the end of said stop member co-operating with a abutment provided on the piston.

16. A firearm according to claim 15, wherein the end of the stop member is engaged in a groove in the piston with the front end of the groove constituting the abutment.

17. A firearm according to claim 1, wherein said coaxial rod on which said cylinder is mounted is capable of swinging about a pivot whose axis is parallel to the cylinder axis.

18. A cylinder for fitting to a firearm, said cylinder including a plurality of chambers each adapted to receive a cartridge, a front face adapted to be mounted adjacent the barrel of the firearm and a rear face through which the cartridges are inserted into the chambers, and further including a channel associated with each chamber and opening out at one end into said chamber adjacent to but spaced from the front face ahead of a cartridge, and at its opposite end into the rear face of the cylinder, said opposite end receiving a piston like closure member capable of sliding freely in said channel and beyond the rear face of the cylinder, and a stop member associated with each closure member to limit the stroke thereof.

* * * * *